United States Patent [19]

Schumann

[11] 3,988,127

[45] Oct. 26, 1976

[54] ELECTROSTATIC PRECIPITATOR APPARATUS AND METHOD

[76] Inventor: John Louis Schumann, 150 Queen Drive South, Little Silver, N.J. 07739

[22] Filed: May 7, 1975

[21] Appl. No.: 575,210

[52] U.S. Cl. ..... 55/13; 55/112; 55/117; 55/133

[51] Int. Cl.[2] ..... B03C 3/74

[58] Field of Search ..... 55/2, 101, 110, 112, 55/13, 111, 117, 124–126, 128, 133, 302, 303, 343

[56] References Cited

UNITED STATES PATENTS

| | | | |
|---|---|---|---|
| 2,565,106 | 8/1951 | Wastvind et al. | 55/126 |
| 2,836,256 | 5/1958 | Caskey | 55/303 |
| 3,365,858 | 1/1968 | Penney | 55/128 |
| 3,599,401 | 8/1971 | Rich | 55/471 |
| 3,887,341 | 6/1975 | Sutter | 55/467 |

FOREIGN PATENTS OR APPLICATIONS

| | | | |
|---|---|---|---|
| 339,625 | 7/1921 | Germany | 55/112 |
| 539,921 | 2/1956 | Italy | 55/110 |
| 331,699 | 7/1930 | United Kingdom | 55/110 |

*Primary Examiner*—Bernard Nozick
*Attorney, Agent, or Firm*—Brumbaugh, Graves, Donohue & Raymond

[57] ABSTRACT

Each precipitation chamber of an electrostatic precipitator has an airlock provided by closable damper means and located in the path of the gas flow through the chamber between the inlet plenum and outlet plenum of the precipitator. Apparatus is provided in association with each airlock for establishing a gas pressure differential between the airlock and the rest of the chamber so that essentially no uncleaned gas can pass by leakage through the airlock to the precipitator outlet. The airlock is established during normal precipitator cleaning (rapping), thereby enhancing the effectiveness of cleaning by stopping gas flow through the chamber during cleaning, increasing particulate fall into the hoppers and permitting optimization of rapping intensity, rate and frequency. Precipitator efficiency is increased significantly by preventing outflow of re-entrained particulates during cleaning.

16 Claims, 5 Drawing Figures

ELECTROSTATIC PRECIPITATOR APPARATUS AND METHOD

BACKGROUND OF THE INVENTION

This invention relates to electrostatic precipitators and, in particular, to a way of greatly improving the operating efficiency of electrostatic precipitators.

It is usually desirable and frequently required to remove impurities entrained in a stream of gas. For example, Federal anti-pollution regulations require removal of particulates, such as fly ash, of the type produced in enormous quantities in combustion gases from the production by utilities of electricity from steam produced in boilers fired with fossil fuels. Large coal-fired boilers, for instance, produce up to 4,000,000 cfm (114,000,000 l/min) of flue gases at temperatures ranging to 1000° F. (538° C.) which entrain large quantities of fly ash and other particulate waste, 1000,000 lbs./hr. (45,000 kg./hr.) of such particulates being a representative quantity. Inasmuch as the pulverized coal burned in many boilers is finely divided when burnt, the resulting ash particulate is very small in size and is difficult to remove from the effluent gas. Recently established air pollution codes commonly require continuous removal of more than 99% of the particulate efflent.

Of several known types of gas cleaning apparatus, electrostatic precipitators have been found to be the most satisfactory for cleaning the very hot and often corrosive flue gases from fossil-fueled boilers and other combustion devices. In 1910, Frederick G. Cottrell described one of the first electrostatic precipitators in a United States Patent, and his name is used as a generic name for a class of electrostatic precipitators. Modern large Cottrell-type electrostatic precipitators usually have several chambers, each chamber being several precipitator cells wide and several precipitator fields deep. The combined cell and field dimensions define commercially available modules, in one type of which total effective cell widths range up to 150 ft. (46 m.), total effective field lengths range up to 45 ft. (14 m.), and effective heights range from 10 ft. (3.0 m.) to 45 ft. (14 m.). Each module comprises plate collectrodes that are relatively closely spaced, e.g. about 9 inches (23 cm.), from each other and extend parallel to the flow of gas to be cleaned in the module to define gas flow passages, and high voltage discharge wire electrodes positioned along the passages between the collectrodes. The wire electrodes are highly charged, often to −40,000 V.D.C., and the collectrodes are grounded. The electrical fields between the electrodes and collectrodes ionize (charge) the gas and particulates flowing through the chamber and the charged particulates are moved by electrostatically generated forces to the relatively lower potential collectrodes where they are retained by electrostatic attraction.

As a layer of charged particulates builds on the collectrodes, the potential (voltage) between the high voltage electrode and the particulate-coating on the collectrodes decreases and gradually decreases the efficiency of the precipitator correspondingly. After a layer of particulates has accumulated to a point (which varies depending on the design and use of the precipitator), it is necessary to clean the collectrodes to remove the collected particulates. Collectrode cleaning is usually done in commercial preecipitators by "rapping," a procedure involving application of a mechanical shock to the collectrodes while normal gas flow and high-voltage powering continues. Rapping causes primarily relatively large agglomerates of the particulates to fall into a hopper below the precipitator, but other particulates, for example, individual particles or small agglomerates, become reentrained in the gas and are carried downstream with the normal gas flow and must be recharged and recollected by a downstream field of the precipitator, lest they flow out with the gas. However, at the end of the precipitator, some of the re-entrained particulates escape through the outlet and are discharged through the slack to the atmosphere. Relatively long gas flow passages, numerous fields in series and relatively low gas flow rates are typical features of modern, high-efficiency precipitators that are incorporated to minimize the percentage of particulates finally reentrained with the discharged gas. Those current design practices make today's precipitators very expensive to construct, operate and maintain.

The following example is given to illustrate more fully and quantitatively the progressive collection of particulates along the gas flow passages of an electrostatic precipitator which is built and operated in accordance with current commercial practice in that collectrode cleaning (rapping) takes place while gas flow continues at normal velocity. In modern precipitators, the great majority of particulate is charged and precipitated on the collectrodes within a few feet of entering the first field of precipitation. Often, about 50% of collected particulate is deposited in the first row of hoppers under the first field. It is believed that the major part of that loss is due to re-entrainment of particulate caused by collectrode cleaning. Assuming for this example that a representative loss due to electrode cleaning is 40% of particulate from each field of a precipitator, Table I then demonstrates that eight fields are required to collect 99.6% of the particulates. In cleaning a representative gas stream in which there is entrained 100,000 pounds per hour of particulates, Table I demonstrates the greatly diminishing effectiveness of successive fields. The first field collects 50,000 pounds of particulate per hour; the eighth field collects (and loses) 390.6 pounds per hour.

TABLE I

| | Pounds Per Hour of Particulate | | | | | |
|---|---|---|---|---|---|---|
| Field | Entering Field | Precipitated on Collectrodes | Agglomerate Dropped Into Hoppers | Lost To Re-entrainment During Rapping Collectrodes | Total Lost to Next Field | Total Percent Collected |
| 1 | 100,000 | 90,000 | 50,000 | 40,000 | 50,000 | 50.0 |
| 2 | 50,000 | 45,000 | 25,000 | 20,000 | 25,000 | 75.0 |
| 3 | 25,000 | 22,500 | 12,500 | 10,000 | 12,500 | 87.5 |
| 4 | 12,500 | 11,250 | 6,250 | 5,000 | 6,250 | 93.7 |
| 5 | 6,250 | 5,625 | 3,125 | 2,500 | 3,125 | 96.9 |
| 6 | 3,125 | 2,812.5 | 1,562.5 | 1,250 | 1,562.5 | 98.4 |
| 7 | 1,562.5 | 1,406.2 | 781.2 | 625 | 781.2 | 99.2 |

TABLE I-continued

| Field | Entering Field | Pounds Per Hour of Particulate: Precipitated on Collectrodes | Agglomerate Dropped Into Hoppers | Lost To Re-entrainment During Rapping Collectrodes | Total Lost to Next Field | Total Percent Collected |
|---|---|---|---|---|---|---|
| 8 | 781.2 | 703.1 | 390.6 | 312.5 | 390.6 | 99.6 |
| TOTALS | | | 99,609.3 | | 390.6* | 99.6 |

*Total Loss to Outlet

There have been various suggestions in the past for minimizing the loss of particulates to the stack of an electrostatic precipitator during rapping. For example, it has been proposed to stop or slow the flow of gas through all or part of an electrostatic precipitator during rapping, thereby reducing the carryout from the precipitator of particulates that become re-entrained in the gas. Among the ideas proposed for that purpose is the provision of doors or louvers at some point or points in the precipitator that can be closed during the rapping cycle. Relatively complicated duct and louver systems have been devised for periodically interrupting or reversing the gas flow through individual chambers of an electrostatic precipitator during a rapping cycle in the chamber.

The arrangements that have been proposed have never been generally adopted for commercial electrostatic precipitators. The difficulty of constructing, maintaining, and operating louvers or other door arrangements in the hot, corrosive environments encountered in electrostatic precipitators has undoubtedly been one of the reasons for the lack of commercialization of such ideas. The proposed arrangements also were not susceptible of completely stopping gas flow through the precipitator, or part of the precipitator, and, therefore, substantial losses in efficiency due to leakage were unavoidable. Accordingly, the tendency in the design of electrostatic precipitators has been to increase the number of fields and to program carefully the rapping cycles among the various fields, as well as to compromise in the design of the rapping system to minimize particulate re-entrainment, but only to the detriment of effective collectrode cleaning.

Those design approaches have permitted total precipitator efficiencies adequate to meet standards required in the past. However, the requirements that are now being imposed on precipitator efficiency can be met based on presently existing technology only by very substantially increasing the size of the precipitator, and, therefore, the costs of building, operating and maintaining it, to increase the number of fields, reduce gas flow velocities, and make additional compromises in rapping procedures.

SUMMARY OF THE INVENTION

There is provided, by the present invention, an electrostatic precipitator in which essentially no particulate is lost due to re-entrainment resulting from periodic cleaning (rapping) of the collectrodes.

In accordance with the invention, each chamber of a multi-chamber precipitator is provided with an airlock for interrupting the normal flow of gas through the chamber during rapping and thereby essentially eliminating the escape of re-entrained particulate caused by rapping through any outlet from the precipitator. Each airlock is provided by two closable damper means for isolating a zone in the path of the gas through the chamber at some place between the inlet and outlet plenums and apparatus for creating a differential between the gas pressure in the airlock and the gas pressure outside the airlock such that any leakage flow through that damper means of the two that is nearer to the downstream end of the last field of the chamber is a reverse flow, i.e., is toward the inlet and reversed in direction from the normal gas flow through the chamber. Thus, the leakage gas flow past that damper means prevents the passage of entrained particulates through and out of the airlock to the precipitator outlet.

That damper means of the two damper means defining the airlock zone that is located the nearer of the two to the downstream end of the last field of the chamber is hereinafter referred to as the "primary damper means," and the other damper means is referred to as the "secondary damper means."

The locations of the damper means for establishing an airlock zone in each chamber of a multi-chamber precipitator are largely a matter of design choice, apart from the requirement that they be located to establish for each chamber the air lock zone somewhere between the inlet plenum and the outlet plenum of the precipitator. It is, however, desirable that the primary damper means be located in proximity to the last field in the chamber and preferably downstream from the last field so that any leakage through the primary damper means is a reversed flow of clean gas.

There are two types of arrangements of the airlock. In one, the primary damper means is located close to and, preferably, downstream from the last field of the chamber, the secondary damper means is located somewhere between the primary damper means and the outlet plenum, and a gas pressure slightly above the pressure in the chamber is established in the airlock to ensure that any leakage past the primary damper means is from the relatively higher presure airlock to the relatively lower pressure chamber. In the other type of arrangement, the primary damper means is again, preferably, located downstream from and close to the last field, the secondary damper means is located upstream somewhere between the inlet plenum and the primary damper means, and the pressure in the airlock is established slightly below the pressure in the outlet flue system again to ensure that any leakage through the primary damper means is reversed from normal gas flow through the precipitator.

As implicit in the preceding paragraph, it is recognized that the primary damper means can be located upstream from the end of the last field of a chamber and that substantial improvements in precipitator efficiency can still be attained. Although there would unavoidably be some loss of re-entrained particulate whenever the field or fields downstream from the primary damper means are rapped, the loss from the downstream field will be much less than the losses that occur in present designs, inasmuch as carryover from fields upstream from the primary damper means during rapping to the fields downstream from the primary damper means is eliminated, and reprecipitation of particulates in fields upstream from the primary damper means occurs prior to opening the airlock.

The invention offers several important advantages. In a precipitator of a given size, the invention will provide substantial improvements in efficiency by eliminating rapping losses. Assuming, on the other hand, a given design efficiency for an electrostatic precipitator, the invention permits substantially reducing the size of the precipitator, again by eliminating rapping losses and thereby permitting the size of the precipitator and number of fields to be reduced, as compared to a conventional precipitator having the same efficiency. Improvements in rapping, as compared to current practices can also contribute to efficiency in that the rate, frequency and magnitude of rapping can be established on the basis of obtaining the most effective removal of particulate rather than being established with a view of minimizing re-entrainment losses. Inasmuch as gas flow through a chamber is stopped during rapping, improvements in particulate fallout into the hopper during rapping are afforded. Moreover, the power to the electrodes can be shut off during rapping, thereby temporarily stopping reprecipitation and enhancing fallout to the hopper. Improvements in the rapping techniques in a shut down chamber necessarily result in improvements in operation when the chamber is put back into operation after rapping.

More particularly, the force heretofore used to clean (rap) the collectrodes was an unsatisfactory compromise between an easy blow to minimize re-entrainment and a hard blow which would effectively clean the collectrodes. With re-entrainment controlled by stopping the flow of gas during rapping, improved collectrode cleaning by harder rapping blows and by repeated rapping blows is made possible without the penalty of increased particulate loss due to uncontrolled re-entrainment.

The quantity of dust fall into the hoppers is increased by increasing time for settlement, by increased settlement through non-turbulent gas, and may be increased further by settlement while the high voltage is turned off.

With the invention there is, moreover, an additional opportunity for increasing dust fall into the hoppers, namely, a controlled period of time when gas flow is stopped and the high voltage power is turned off. During this period, the collectrodes may be shocked by a series of hammer blows of increasing intensity. The first light blow will disturb the precipitated dust layer, causing the substantial settling of large agglomerates with a minimum of shattering, a harder blow will continue settling and begin final cleaning, and maximum cleaning will be accomplished with maximum hammer blows only after the lighter blows have encouraged setting of the agglomerates.

Table II below, which is bases on the same assumptions upon which Table I above is bases except for a reduction from 90% to 80% in precipitation in each field, shows how the size of a precipitator can be greatly reduced by using the invention and thereby essentially eliminating rapping losses. The data in Table II take into account a reduction in effectiveness of precipitation in each field due to shortened treatment times during periods of rapping when individual chambers are out of service.

TABLE II

| | | Pounds Per Hour of Particulate | | | | |
|---|---|---|---|---|---|---|
| Field | Entering Field | Precipitated on Collectrodes | Agglomerates Dropped Into Hoppers | Lost to Re-entrainment During Rapping Collectrodes | Total Lost to Next Field | Total Percent Collected |
| 1 | 100,000 | 80,000 | 80,000 | 0 | 20,000 | 80.0 |
| 2 | 20,000 | 16,000 | 16,000 | 0 | 4,000 | 96.0 |
| 3 | 4,000 | 3,200 | 3,200 | 0 | 800 | 99.2 |
| 4 | 800 | 640 | 640 | 0 | 160 | 99.8 |
| TOTALS | | | 99,840 | | 160* | 99.8 |

*Total Lost to Outlet

DESCRIPTION OF THE DRAWINGS

The following description of exemplary embodiments of the invention should be considered in conjunction with the accompanying drawings in which.

DESCRIPTION OF THE PREFERRED EMBODIMENT

Figure 1:
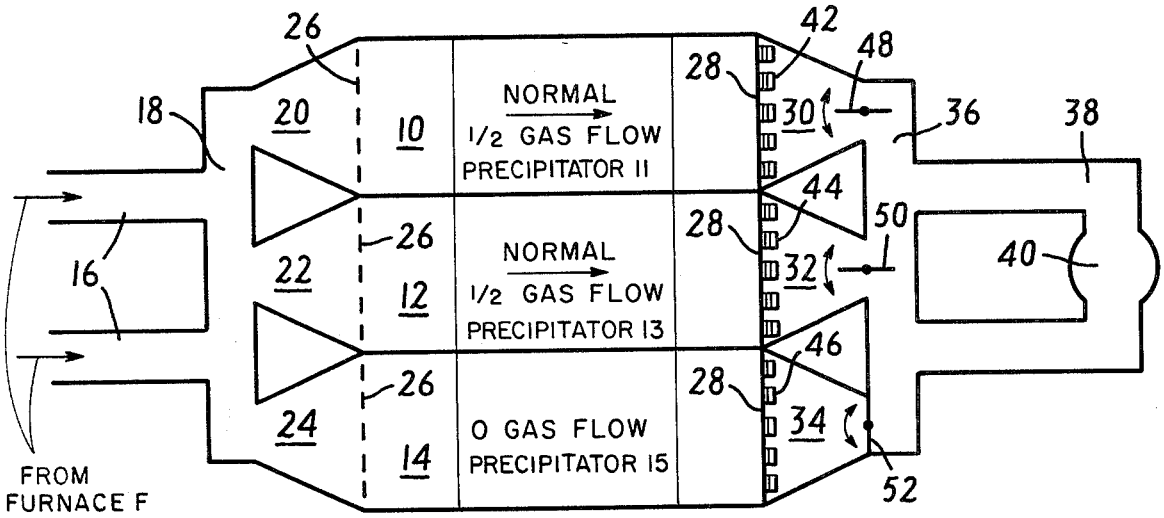
FIG. 1 is a schematic plan view of one embodiment of a precipitator, according to the invention.

In the embodiment shown in FIGS. 1 to 4, the precipitator comprises three identical or similar chambers 10, 12, 14, each of which contains electrostatic precipitator units 11, 13, 15 respectively of any suitable type, many of which are known per se. For example, each precipitator unit may comprise a plurality of vertical, grounded plate collectrodes extending parallel to the normal direction of gas flow (which is indicated by the arrows in FIG. 1) and a plurality of high voltage discharge wire electrodes between each pair of collectrodes. Such precipitators are usually assembled from one or more modules having cell, field, and height dimensions selected for achieving the desired operation. The number of chambers of the precipitator and the number of cells and fields in each chamber may vary widely, as a matter of design of a particular precipitator. However, the invention contemplates at least two, and preferably three or more chambers, each of which can be isolated from the others for rapping.

A flow of gas to be cleaned, for example from a furnace F, in the precipitators is supplied through inlet flues 16 to an inlet plenum 18. Inlet nozzles 20, 22, 24 are designed, as known in the art, to divide generally equally the gas flowing from the plenum among each of the precipitation chambers. Additional uniform distribution of the flowing gas within the chambers is commonly provided by appropriate baffles (not shown) within the flue system and inlet nozzles and a perforated plate or screen 26 at the connection of each inlet nozzle to its respective precipitation chamber.

At the downstream end of each of the chambers, another perforated plate 28 contributes to uniform flow of the gas from the chamber to an outlet nozzle 30, 32 or 34. Each outlet nozzle is connected to an outlet plenum 36, which is, in turn, connected to an outlet flue system 38 for conducting the gas cleaned in the precipitation chambers to a stack 40 for discharge to the atmosphere. The arrangement thus far described for carrying gases to be cleaned from an inlet flue to an electrostatic precipitator and gases cleaned in the precipitator to a discharge stack is well known per se and widely used in smoke cleaning, such as in the effluent gases of combustion from large boilers.

Each precipitator field has one or more rappers (not shown) for providing an impulse to the collectrodes which shears and otherwise removes collected particulates from the collectrodes, and hoppers (not shown) below the collectrodes for receiving the particulate removed from the collectrodes.

In the embodiment of FIGS. 1 to 4, and in accordance with the invention, each of the outlet nozzles 30, 32 and 34 is equipped with an airlock constituted by a primary damper means 42, 44 or 46 at the connection of each nozzle 30, 32 and 34 to its respective precipitation chamber, a secondary damper means 48, 50 or 52 at the connection of each nozzle 30, 32 and 34 to the outlet plenum 36 and apparatus 54 (see FIG. 2) for establishing in each airlock a gas pressure above the pressure in the respective chamber 10, 12 or 14.

GENERAL DESCRIPTION OF OPERATION

At those times in the operation of the precipitator when no rapping is occurring, the damper means of all three airlocks of the precipitator are open to permit about equal amounts of gas to flow through each chamber for removal of particulate. At programmed or controlled intervals, selected ones or all fields in each chamber are rapped, each chamber being rapped individually while the other chambers remain in operation. For example, as shown in FIG. 1, the damper means 42, 44 and 48, 50 of the airlocks 30, 32 are open to permit normal flow of gas cleaned in the associated precipitation chambers 10, 12 to the stack 40. However, the damper means 46, 52 of the airlock 34 are closed, and the airlock pressurized, as later described, to block the flow of gas from the associated precipitation chamber 14. One-half the gas from the inlet plenum 18 will then flow through each of the precipitation chambers 10, 12 for cleaning, the precipitators in these chambers each being designed to clean one-half the gas flow to the extent required for discharge from the stack.

While the airlock 34 blocks gas flow through the precipitation chamber 14, the collectrodes (not shown) of the precipitator in the chamber 14 are rapped by the rappers (not shown) associated with the collectrodes or otherwise cleaned of collected particulates. Much of the particulates, particularly agglomerates, drop by gravity into the hopper (not shown) below the collectrodes. Cleaning of the collectrodes may be accomplished with the high voltage on the discharge electrodes or, preferably, by cutting off the high voltage from the discharge electrodes or even reversing the relative potential between the collectrode and discharge electrodes for additional, electrostatic cleaning of the collectrodes. Moreover, the strength, number and frequency of raps may be varied to optimize cleaning of the collectrodes. Inasmuch as there is essentially no gas flow through the precipitation chamber 14 in the direction of the outlet, none of the particulates cleaned from the collectrodes will move in a direction toward or escape through the outlet.

After cleaning the collectrodes of the precipitator in the precipitation chamber 14, the desired negative discharge and ground potential, if altered or terminated during rapping, are re-established on the discharge electrodes and collectrodes for reprecipitating any particulates which have not settled into the hopper below the precipitator. After an interval sufficient substantially to clear the gas in the chamber 14 of particulates by settling into the hoppers or by reprecipitation, or both, the apparatus for pressurizing the airlock 34 is then shut off and the damper means 46, 52 opened to permit normal gas flow through the precipitation chamber 14.

In one mode of operation, then, each of the precipitation chambers 10, 12, 14 carries one-third of the gas flow from the inlet plenum 18. When it comes time to rap in any one of the chambers, the damper means of the airlock associated with that chamber (for example, dampers 42, 48 of airlock 30) are closed and the airlock pressurized. Essentially no gas will then flow through the associated precipitation chamber toward the outlet. During shutdown for rapping of any one of the chambers, one-half of the total gas flow will be divided equally between the other precipitation chambers, which will clean the gas before its discharge from the stack 40, as before described. Appropriate devices for sequentially activating under a predetermined or controlled plan the damper means and rappers associated with the precipitation chambers are well known and thus need not be described here.

It will be understood from the description of these modes of operation that the illustrated three-chamber precipitator is merely exemplary, and that the apparatus may be satisfactorily operated with two or more precipitation chambers. In general, three or more chambers will be provided, thereby to minimize the increase in gas flow rates through operating chambers when a chamber is shut down for rapping.

MORE DETAILED DESCRIPTION

Figure 2:
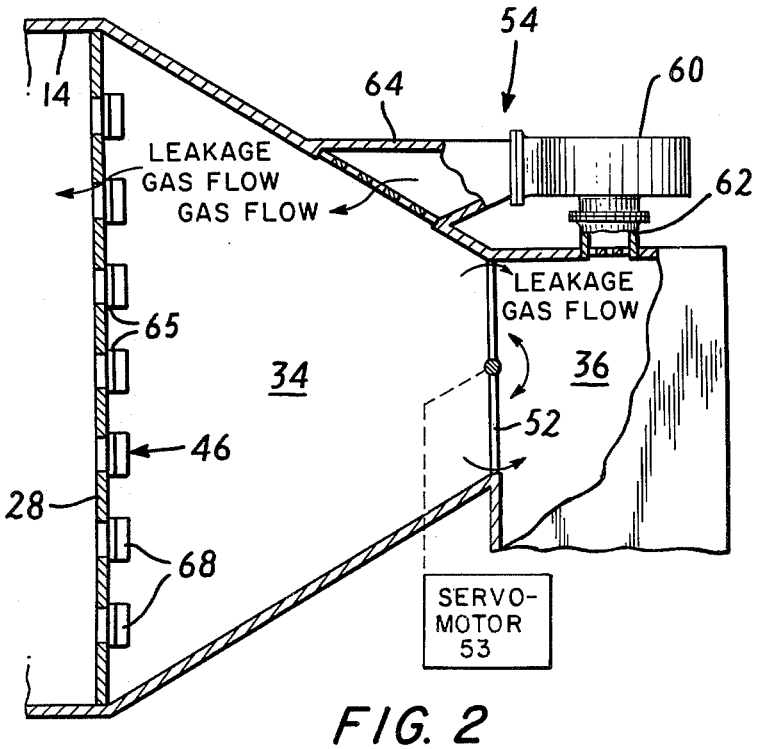
FIG. 2 is a more detailed schematic bottom view of a portion of the embodiment shown in FIG. 1.

FIG. 2 shows the apparatus 54 for pressurizing the airlock 34, each other airlock having similar pressurizing apparatus as before described. With the dampers 46, 52 closed, a motor driven back pressure blower 60 draws cleaned gas from the outlet plenum 36 through duct 62. The cleaned gas is then forced by the blower through a back pressure flue 64 into the airlock 34 to increase the pressure in the airlock above that impinging on the damper 46 and air distributing perforated plate 28 from the associated precipitation chamber 14. The airlock thus forms a zone in the path of normal gas flow which is isolated by the dampers and the pressure differential from both the precipitation chamber and outlet plenum.

The volume of the pressurizing, cleaned gas forced into the airlock 34 is such that gas which may leak past the dampers 46, 52 under the pressure differential from the airlock to the precipitation chamber and from the airlock to the outlet plenum does not alter described relative pressures. The direction of this leakage flow of cleaned gas from the airlock 34 through the dampers 46, 52 is then indicated by the leakage gas flow arrows at the dampers. Inasmuch as the leakage gas flow through the damper 46 is directed into the precipitation chamber 14, essentially no uncleaned gas or particulate then escapes into the airlock 34 from the precipitation chamber. Essentially no particulate will then escape from the airlock with the leakage flow of cleaned gas past damper 52 for discharge from the outlet stack. Since the gas in each chamber is cleared of particulate before opening the airlock 34 to normal gas flow, essentially no particulate will escape from the precipitation chamber when the airlock is opened again to permit the normal gas flow.

The damper 52, like similar dampers 48, 50 (FIG. 1), is illustrated schematically in FIG. 2 as a louver-type device centrally pivoted at the connection of the air lock to the outlet plenum for rotational movement by any of known devices such as two-position servo motor 53 to open or close the gas flow connection between the airlock 34 and the outlet plenum 36. Inasmuch as the airlock is pressurized with cleaned gas, the louver damper 52 need not seal the connection between the airlock and outlet plenum. For example, it may have a relatively large clearance tolerance between edges of the damper and sides of the connection between the airlock and outlet plenum, the extent to which the damper 52 closes the gas flow connection being a design consideration relative to the capacity of the blower required for pressurizing the airlock. With the relatively large, non-gas-tight tolerance between the damper 52 and the gas flow connection from the airlock to the outlet plenum, differences in thermal expansion between the damper, airlock, and outlet plenum and accumulated debris in the apparatus will not interfere with operation of the damper 52 and gasket or other materials for forming gas-tight seals, which often do not well withstand the hot and corrosive atmosphere of the gas, need not be used. The single blade damper is only exemplary, and many other types of damper means can readily be employed.

Figure 3:
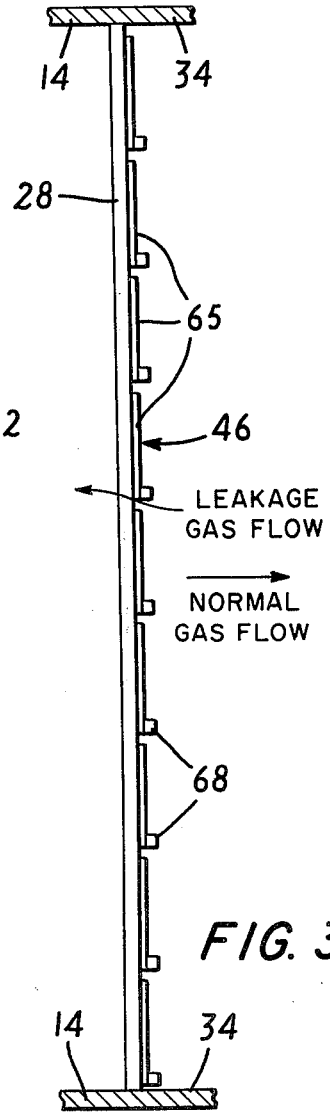
FIG. 3 is an elevational view, also of generally schematic form, of a portion of the embodiment shown in FIG. 2.
Figure 4:
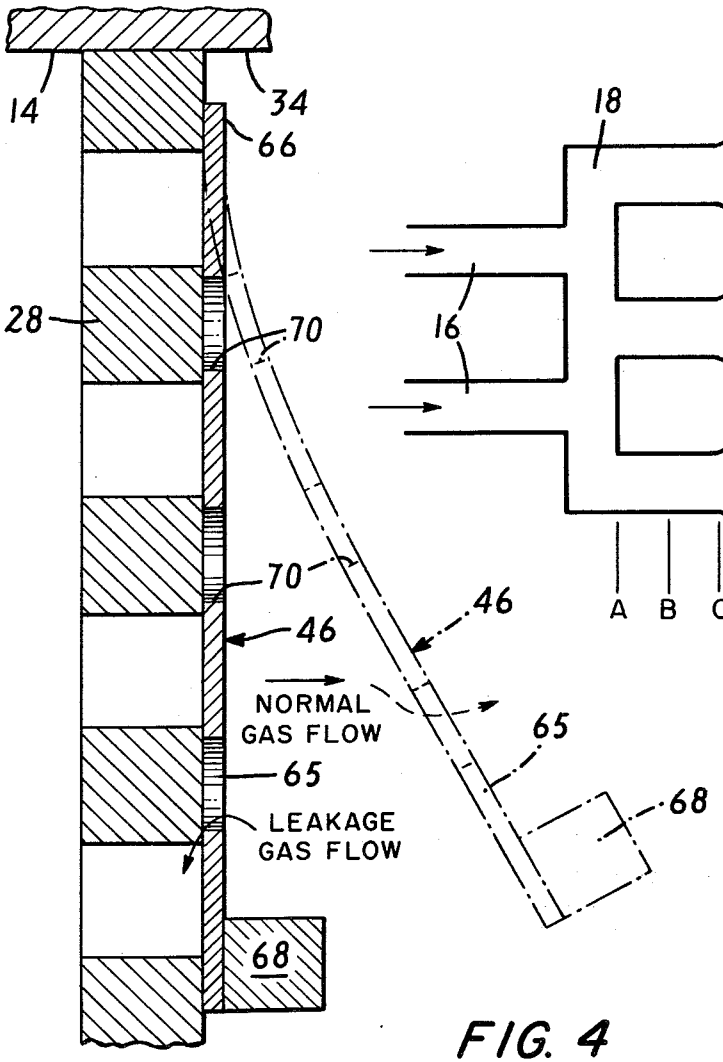
FIG. 4 is a more detailed elevational view, also of generally schematic form, of part of the portion of the embodiment shown in FIG. 3.

As best seen in FIG. 4, the damper 46 (shown in its entirety in FIG. 3) comprises several flexible strips 65, each of which is hung at its upper end 66 from the perforated plate 28 at the outlet from the associated precipitation chamber 14. The other dampers 42, 44 associated with the other precipitation chambers are similarly constructed. A weight 68 is connected to a lower end of each strip 65 to urge the strip against the perforated plate. Each strip 65 preferably has holes 70 at positions corresponding to solid portions of the perforated plate 28 to facilitate even gas flow when the damper is opened, as indicated by the arrows in the phantom portion of FIG. 4.

As shown in FIG. 3, the entire damper 46 preferably comprises an array of flexible strips 65. Each strip is then smaller than the perforated plate 28 connecting a precipitation chamber to its associated airlock, the entire array of flexible members substantially covering the perforated plate collectively to close the damper 46 when the airlock 34 is pressurized.

MORE DETAILED DESCRIPTION OF OPERATION

Returning briefly to FIG. 2, a chamber, for example, the chamber 14, is shut down for rapping by first rotating the damper 52 to the closed position (as shown) substantially to stop the gas flow from the airlock 34 to the outlet plenum 36, and, in turn, to stop gas flow through the chamber 14 and past the damper 46. At about the same time, the back pressure blower 60 is started up to deliver clean gas from the outlet plenum to the airlock 34. The slowing of gas flow through the damper 46 and the increasing pressure in the airlock 34 tends to reduce the forces holding the primary damper 46 open.

Turning to FIG. 4, the direction of normal gas flow from the precipitation chamber 14 through the outlet perforated plate 28 before the damper 52 closes is indicated by the arrow. That gas flow is sufficient to swing the flexible strips 65 away from the perforated plate to open the damper 46, as shown in phantom. As mentioned above, the holes 70 in the flexible strips 65 facilitate uniform gas flow through the strips 65 but the holes are not required. Moreover, various other damper means can be used in place of the strip type shown in the drawings. Strip type damper means using strips of rigid material pivoted to swing open and closed is but one example of such other damper means.

As the normal flow of cleaned gas is reduced by closing the damper 52 and starting the pressurization of the airlock, the flexible strips swing under the influence of gravity against the perforated plate, the weight 68 serving to further urge swinging of the strips against the plate. With the flexible strips then resting against the perforated plate, the damper 46 is substantially closed. The pressure in the airlock 34 may then rise above that in the associated precipitation chamber, the volume of air needed for such pressurization being only that required for slightly raising the pressure in the airlock above the pressure in the chamber.

Inasmuch as the flexible strips 65 forming the damper 46 only rest against the outlet perforated plate 28, there may be some leakage gas flow between the flexible strips and the perforated plate. However, inasmuch as the pressure in the airlock 34 is then higher than that in the precipitation chamber 14, that leakage gas flow will be in a direction from the airlock 34 into the precipitation chamber 14, as indicated by the arrow in FIG. 3. Essentially no uncleaned gas or particulates in the precipitation chamber 14 during cleaning of its electrodes will flow into the airlock 34, and such leakage gas flow, which is in the reverse direction from the normal gas flow, eliminates essentially the possibility of particulates in the chamber 14 flowing into the airlock 34 and thence to the stack during rapping. Thus, the damper strips 65 can be made from metal or other materials which can withstand the heat and corrosiveness of the flowing gas but are unlikely to make a good seal.

As soon as the airlock 34 is established in association with the chamber 14 and the flow of gas through that chamber is stopped, any suitable rapping procedure to remove particulate from the collectrodes in the chamber can be carried out, inasmuch as the gas flow through the chamber has been stopped and the loss of re-entrained particulates prevented. The specific rapping procedure selected may be established on the basis of optimizing the effectiveness of collectrode cleaning rather than on the basis of a compromise between effective collectrode cleaning and minimizing particulate lost to the stack, as is the present design practice.

An exemplary rapping procedure may involve de-energizing the electrodes, applying a light rapping to the collectrodes to shear agglomerated particulate from the collectrodes so that it can rapidly fall into the hoppers with a minimum of re-entrainment followed by increasingly hard rapping for removal of additional particulates from the collectrodes that were not removed in the initial light rapping. With the chamber 14 still shut down, the electrodes are re-energized to re-precipitate re-entrained particulate. Re-energization of the electrodes after rapping is preferably delayed for, say, a few seconds, to allow settling of some of the re-entrained particulates and smaller sized agglomerates. As soon as reprecipitation of re-entrained particulates has been completed, the airlock 34 is opened and normal operation of the chamber 14 restored.

During the time that a given chamber is shut down for rapping, the portion of gas processed in the precipitator that was previously being handled in that given chamber is diverted to the other chambers of the precipitator. The invention contemplates providing a sufficient number of chambers and designing each of the chambers to operate effectively on the basis of carrying a share of the gas flow from a shut-down chamber. It is not unusual, according to present day practice in the design of multi-chamber precipitators, to allow for increased gas flow in each chamber against the likelihood that one or more chambers will in normal operation be shut down from time to time for maintenance and repair, and it is well within the state of the art to provide specific design parameters in a precipitator according to the present invention that allow for redistribution of gas flow from time to time among the several chambers.

ALTERNATIVE EMBODIMENTS

The embodiment of the invention illustrated in FIGS. 1 to 4 of the drawings is exemplary of the invention and numerous variations and modifications of the embodiment may be made by those skilled in the art without departing from the spirit and scope of the invention.

Figure 5:
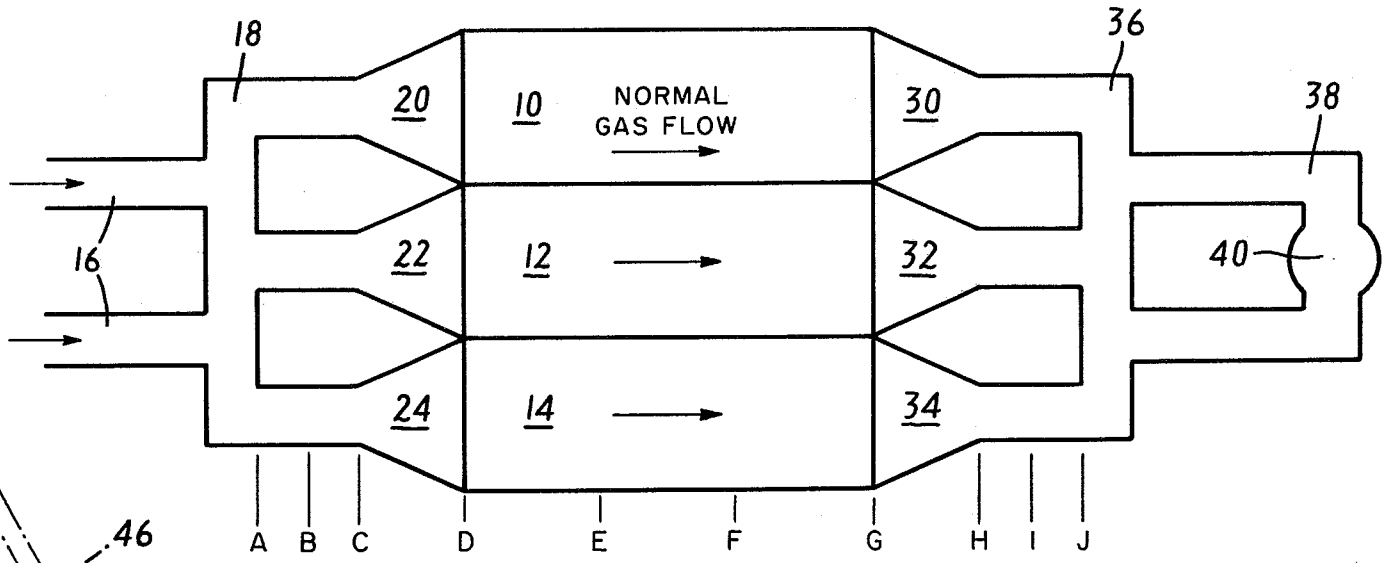
FIG. 5 is a sectional schematic plan view showing alternative locations for the airlocks.

One such type of modification involves the positions of the airlocks and, in particular, the locations of the damper means. The lines designated by the letters A to J in FIG. 5 illustrates some of the locations for the damper means that can be selected. In general, it is highly desirable to locate the primary damper means close to and downstream from the last field of each precipitator chamber, i.e., the position of G in FIG. 5. The position of the primary damper means may, however, be moved upstream or downstream from the position G, but repositioning it is likely to result in some loss of re-entrained particulates, either during rapping in a given chamber or after rapping in the chamber has been completed and the chamber is put back into operation. For example, if the primary damper means is moved toward the position H, re-entrained particulates from the chamber in question will tend to migrate into the portion of the outlet nozzle upstream from the primary damper means and will not be reprecipitated but will flow into the stack when the chamber is returned to operation after rapping. The degree of migration of re-entrained particulates into the nozzle can be minimized by intentionally designing into the primary damper means a relatively high leakage that will tend to carry re-entrained particulates back into the chamber for reprecipitation before the airlock is opened and the normal gas flow through the chamber restored.

Moving the primary damper means upstream from the position G of FIG. 5, for example, to a position between the last two fields as indicated generally by the position of the lettered line F in FIG. 5, will mean loss of re-entrained particulates produced by rapping in the last field. However, the location of the primary damper means at the position F prevents carryover of re-entrained particulates from the upstream fields which, in turn, means that the last field in the chamber is not called upon to precipitate re-entrained particulates from upstream fields. Moreover, if the secondary damper means is located at the position G, with the primary damper at position F, the only loss from the last field will be leakage past the secondary damper; re-entrained particulates in the last field can be re-precipitated before opening the airlock.

The secondary damper means can be located at any of the positions A to J, inclusive, with the qualification, of course, that the primary and secondary dampers have to be spaced apart a distance sufficient to permit them to operate mechanically. If the secondary damper of an airlock is located downstream from the primary damper, for example, the positions, H, I, & J in FIG. 5, the airlock will be maintained at a pressure slightly above the pressure in the chamber by conducting a clean gas at a higher pressure than in the chamber into the airlock zone. If the secondary damper is located upstream from the primary damper, the positions A to F in FIG. 5, the pressure in the airlock is reduced slightly below the pressure downstream of the primary damper, located at any position, G, H, I, or J, by withdrawing gas from the airlock and conducting it back to the inlet plenum of the precipitator or into another chamber. A reduction in pressure in the airlock in this type of airlock arrangement creates a pressure different across the primary damper means to establish a leakage flow in the upstream direction and, according to the principle of the present invention, prevents loss of re-entrained particulates produced by rapping from flowing from the chamber to the outlet.

As a general matter, the preferred positions for the airlock zones for the chambers of a precipitator are downstream from the last field of each chamber, i.e., the positions G to J, inasmuch as the blower or blowers for pressurizing the airlock will be handling clean gas rather than contaminated gas as is the case with positions A to G.

Instead of providing separate blowers for establishing a differential pressure beetween each airlock of the precipitator, a blower or blowers may serve several airlocks via duct systems that include controlled valves to take or deliver gas from or to selected airlocks.

I claim:

1. A method of operating an electrostatic precipitator which has at least two separate conduit means for conducting gas to be cleaned from an inlet plenum to an outlet plenum, each of said conduit means containing means for electrostatically precipitating particulates from a gas flowing therethrough, said method comprising the steps of causing the gas to be cleaned to flow through one of the conduit means and causing particulates therein to be electrostatically precipitated and collected while cleaning collected particulates from the precipitating means in the other conduit means by establishing in said other conduit means an isolated zone by blocking said other conduit means in two spaced-apart locations including a primary location in proximity to the downstream end, relative to the normal direction of gas flow between the plenums, of said precipitator means, and a secondary location spaced from said first location, establishing in the isolated zone a gas pressure that is different from the gas pressure in said other conduit means outside of the isolated zone such as to cause any leakage flow at said primary location to be in a direction reversed from the direction of normal gas flow through said conduit means, rapping the precipitator means in said other conduit means while the gas flow through said first conduit means is blocked and while the reversed leakage flow is maintained, cleaning the gas in said other conduit means of reentrained particulates after rapping has stopped and while the gas flow therein is blocked and said reversed leakage flow is maintained, and unblocking said other conduit means to reestablish gas flow through and precipitation in said other conduit means.

2. A method according to claim 1 in which the isolated zone is established downstream from the downstream end of the precipitator means and the pressure in the isolated zone is raised above the pressure in said other conduit means outside of the isolated zone.

3. A method according to claim 2 wherein the step of establishing a gas pressure in the isolated zone includes clean gas from the outlet plenum of the precipitator into the isolated zone.

4. A method according to claim 1 wherein the isolated zone is established upstream from the downstream end of the precipitator means and the pressure in the isolated zone is reduced below the pressure in said other conduit means outside of the isolated zone.

5. A method according to claim 4 wherein the step of establishing a gas pressure in the isolated zone includes conducting gas from the isolated zone to the inlet plenum of the precipitator..

6. An electrostatic precipitator for cleaning particulates from the gases discharged from furnaces, boilers and the like comprising an inlet plenum to receive the gases, at least a first and a second conduit means connected to the inlet plenum to receive the gases from the inlet plenum, means in each of said first and second conduit means for electrostatically precipitating particulates from the gases, on outlet plenum connected to each of said conduit means to receive cleaned gases therefrom, each of said conduit means defining a separate path for flow of the gases to be cleaned from the inlet plenum to the outlet plenum, and means in each of said conduit means for selectively establishing an airlock therein, the airlock means in each of said conduit means including primary damper means in said conduit means located in proximity to the downstream end, relative to the normal direction of gas flow through said conduit means from the inlet plenum to the outlet plenum, of said precipitating means, and secondary damper means in said conduit means located in spaced relation to said primary damper means, each of said primary damper means and secondary damper means being selectively closable to restrict gas flow between the parts of the conduit means on opposite sides thereof and openable to permit gas flow between said parts, and said primary damper means and secondary damper means together defining between them when closed an isolated zone in said conduit means, and said airlock means further including means connected to said conduit means between the damper means for selectively establishing a gas pressure in said isolated zone which is different from the gas pressure in the part of the conduit means outside said isolated zone such that the gas pressure on the downsteam side of the primary damper means is higher than the gas pressure on the upstream side thereof and thus any leakage gas flow through the primary damper means is in a direction opposite from the normal direction of gas flow through said conduit means.

7. An electrostatic precipitator as claimed in claim 6 wherein the secondary damper means is located downstream, relative to the normal direction of gas flow along the respective path between the plenum, from the primary damper means and wherein the means for establishing a gas pressure in the isolated zone is adapted to establish a gas pressure in the isolated zone above the pressure in the path upstream from the primary damper means.

8. An electrostatic precipitator as claimed in claim 7 wherein the gas pressure establishing means includes means for taking gas from a source of clean gas and conducting clean gas into the isolated zone.

9. An electrostatic precipitator as claimed in claim 8 wherein the source of clean gas is the outlet plenum and wherein the gas pressure establishing means is a blower.

10. An electrostatic precipitator according to claim 6 wherein the secondary means is located upstream, relative to the normal direction of gas flow along the respective path between the plenum, from the primary damper means, and wherein the gas pressure establishing means is adapted to establish a pressure in the isolated zone below the pressure in the respective path downstream from the primary damper means.

11. An electrostatic precipitator as claimed in claim 10 wherein the gas pressure establishing means of each airlock means includes means for conducting gas from the isolated zone thereof to at least one other conduit means of the precipitator.

12. An electrostatic precipitator as claimed in claim 11, wherein the gas pressure establishing means includes means for conducting gas from the isolated zone to the inlet plenum.

13. An electrostatic precipitator as claimed in claim 6 wherein the primary damper means includes a member mounted for swinging movement selectively to open upon normal gas flow and to close by gravity forces with reduced gas flow.

14. An electrostatic precipitator as claimed in claim 13 wherein the primary damper means comprises an array of the flexible members.

15. An electrostatic precipitator as claimed in claim 13 wherein a secondary damper means includes actuating means selectively operable to open it for normal gas flow and close it to promote closing of the primary damper means.

16. An electrostatic precipitator as claimed in claim 3 wherein the primary damper means includes a perforated plate and wherein the member is mounted adjacent to its upper end on the perforated plate and has a plurality of holes at intervals corresponding to solid portions of the perforated plate for facilitating normal gas flow when the member swings away from the perforated plate with the normal gas flow.

* * * * *

UNITED STATES PATENT AND TRADEMARK OFFICE

CERTIFICATE OF CORRECTION

PATENT NO. : 3,988,127

DATED : October 26, 1976

INVENTOR(S) : John Louis Schumann

It is certified that error appears in the above-identified patent and that said Letters Patent are hereby corrected as shown below:

Column 1, line 19, "1000,000" should be --100,000--; line 27, "efflent" should be --effluent--; Column 2, line 25, "slack" should be --stack--; Column 4, line 48, "presure" should be --pressure--; Column 5, line 33, "of" should be --to--; line 55, "increasing" should be --increased--; Column 6, line 2, "setting" should be --settling--; lines 4 and 5, "bases" should be --based--;

Column 8, line 3, "collectrode" should be --collectrodes--; Column 11, line 45, "illustrates" should be --illustrate--; Column 12, line 31, delete comma (,) after "position"; line 35, "different" should be --differential--; line 49, "beetween" should be --between--; Column 13, line 25, after "includes" insert --conducting--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*